US005800263A

United States Patent [19]

Hayashida et al.

[11] Patent Number: 5,800,263

[45] Date of Patent: Sep. 1, 1998

[54] GAME MACHINE

[75] Inventors: Kohichi Hayashida, Yamato; Takuya Ando, Kawasaki, both of Japan

[73] Assignee: Konami Co., Ltd., Hyogo-ken, Japan

[21] Appl. No.: 604,514

[22] Filed: Feb. 21, 1996

[30] Foreign Application Priority Data

Feb. 21, 1995 [JP] Japan ..... 7-055226

[51] Int. Cl.[6] ..... A63F 9/14

[52] U.S. Cl. ..... 463/6; 463/16; 463/25; 463/58

[58] Field of Search ..... 463/1, 6, 5, 30, 463/31, 34, 40, 58, 59, 60, 62, 63, 16, 23, 25, 29; 364/410, 412

[56] References Cited

U.S. PATENT DOCUMENTS

| | | | |
|---|---|---|---|
| 3,709,493 | 1/1973 | Lally | 463/58 |
| 3,729,193 | 4/1973 | Labis | 463/60 |
| 3,815,912 | 6/1974 | Wichinsky | 463/58 |
| 4,290,757 | 9/1981 | Marshall et al. | 434/22 |
| 4,449,114 | 5/1984 | Fascenda et al. | 463/59 |
| 4,824,374 | 4/1989 | Hendry et al. | 434/22 |
| 4,844,462 | 7/1989 | Lubniewski | 463/6 |
| 4,951,039 | 8/1990 | Schwendeman | 463/40 |
| 5,317,394 | 5/1994 | Hale et al. | 348/262 |
| 5,320,351 | 6/1994 | Suzuki | 463/6 |
| 5,366,229 | 11/1994 | Suzuki | 434/22 |
| 5,472,192 | 12/1995 | Eto | 463/6 |
| 5,501,455 | 3/1996 | Hirata et al. | 463/6 |

FOREIGN PATENT DOCUMENTS

| | | |
|---|---|---|
| A0285586 | 10/1988 | European Pat. Off. . |
| 516160A1 | 12/1992 | European Pat. Off. . |
| 695569A1 | 2/1996 | European Pat. Off. . |
| A4235039 | 4/1994 | Germany . |
| A2161251 | 1/1986 | United Kingdom . |
| 2219746 | 12/1989 | United Kingdom . |
| A9307437 | 4/1993 | WIPO . |
| WO9309523 | 5/1993 | WIPO . |
| A9415165 | 7/1994 | WIPO . |

OTHER PUBLICATIONS

Patent Abstracts of Japan No. JP6187492, vol. 18 No. 536 P-1811), Oct. 12, 1994 & JP-A-06 187492 (Nireco Corp), Jul. 8, 1994.

Patent Abstracts of Japan, vol. 013, No. 353 (P-913), 8 Aug. 1989 & JP-A-01 112490 (Kenro Motoda), 1 may 1989.

*Primary Examiner*—Jessica Harrison
*Assistant Examiner*—Mark A. Sager
*Attorney, Agent, or Firm*—Jordan and Hamburg

[57] ABSTRACT

A race game machine in which a race is conducted by competingly moving a plurality of movable objects along a running path. The machine includes: a parameter storage device which stores at least one parameter used to control movements of the movable objects; a target position calculation device which calculates target positions of the respective movable objects at intervals of a predetermined period in accordance with the parameter stored in the parameter storage device; and a movement control device which controllably moves the movable objects toward their target positions calculated by the target position calculation device. The machine can have an increased number of race developments, thus remaining interesting over a long term.

16 Claims, 6 Drawing Sheets

GAME MACHINE

BACKGROUND OF THE INVENTION

This invention relates to a game machine for conducting a race by competingly moving a plurality of movable objects simulating, e.g., racing cars and racing horses on a running track.

Race game machines of this type have been known, e.g., in Japanese Unexamined Patent Publication No. 1-94884. Description is to be given, taking the race game machine disclosed in this publication as an example. In this game machine, a plurality of model horses simulating racing horses run on a running track, and players enjoy the game by predicting which horse wins the race and betting his medal (s) on their predicted horses. In the game machine disclosed in the above publication, the respective model horses are enabled to freely run on the running track. There are also game machines of type in which the respective movable objects run along the fixed track.

However, in the prior art race game machines as described above, a plurality of race developments, i.e. a plurality of processes of controlling movements of the respective movable objects to determine which movable object wins the race are stored in advance, and the movable objects are controlled in accordance with the race development selected before the start of the race. Accordingly, after having played the game a plurality of time, the player may know before completion of the race which movable object wins the race, making the game uninteresting. In order to avoid such an incident, a greater number of race developments may be stored, but this leads to an increased capacity of a storage medium and, therefore, to an increased production cost.

In addition, if a specific movable object is brought into an uncontrollable state due to a mechanical or electrical trouble, it may be difficult or impossible, depending upon the degree of the trouble, to further execute the predetermined race development.

SUMMARY OF THE INVENTION

It is an object of the present invention to provide a race game machine which has overcome the problems residing in the prior art.

It is another object of the present invention to provide a race game machine which provides players with an interesting game without increasing a production cost and has an excellent restorability against a trouble.

The present invention is directed to a race game machine in which a race is conducted by competingly moving a plurality of movable objects along a running path, comprising: a parameter storage device which stores at least one parameter used to control movements of the movable objects; a target position calculation device which calculates target positions of the respective movable objects at intervals of a predetermined period in accordance with the parameter stored in the parameter storage device; and a movement control device which controllably moves the movable objects toward their target positions calculated by the target position calculation device.

In the game machine thus constructed, the target positions of the respective movable objects are calculated in real time in accordance with the parameter at that moment at intervals of the predetermined period, and the movable objects are controllably moved toward their target positions calculated and determined in real time.

Preferably, the game machine may further be provided with a position detection device which detects the positions of the respective movable objects on the running path. The target position calculation device may calculate the target positions of the movable objects at intervals of the predetermined period in accordance with the positions of the movable objects detected by the position detection device and the parameter stored in the parameter storage device.

In this construction, the target positions of the movable objects are determined not only by the parameter at that moment, but also by the positions thereof.

The target position calculation device may preferably calculate the target position of a specific movable object in accordance with the positions of a plurality of movable objects located around the specific movable object. Then, the target positions of the movable objects are determined not only by the parameter at that moment, but also by the positions of the movable objects around them.

The movement control device may preferably be provided with a difference calculation device which calculates a difference between the target position of each movable object calculated by the target position calculation device and the position thereof detected by the position detection device. The movement control device controllably moves the respective movable objects in such directions as to make the differences calculated by the difference calculation device smaller. With this arrangement, the respective movable objects are controllably moved so as to approach their target positions.

Preferably, a plurality of parameters are stored in the parameter storage device. Then, the target position calculation device calculates the target positions of the movable objects at intervals of the predetermined period in accordance with the plurality of parameters stored in the parameter storage device.

The game machine may further be provided with a first parameter value determination device which determines a value of at least one of the plurality of parameters every time the race is conducted. With this construction, the values of the parameters used are determined for each race, thereby changing the race development.

The game machine may further be provided with a second parameter value determination device which determines a value of at least one of the plurality of parameters at intervals of a specified period. With this construction, the values of the parameters are successively determined during the race, thereby changing the race development.

The movement control device may preferably be provided with a transmission device which transmits to each movable object a control signal used to control the movement thereof. Further, each movable object may preferably be provided with a reception device which receives the control signal transmitted from the transmission device, and a drive device which drives the movable object itself toward the tar(get position thereof in accordance with the control signal received by the reception device.

These and other objects, features and advantages of the present invention will become more apparent upon a reading of the following detailed description and accompanying drawings.

DETAILED DESCRIPTION OF THE PREFERRED EMBODIMENT OF THE INVENTION

One preferred embodiment of the present invention will be described in detail with reference to the accompanying drawings.

Figure 1:
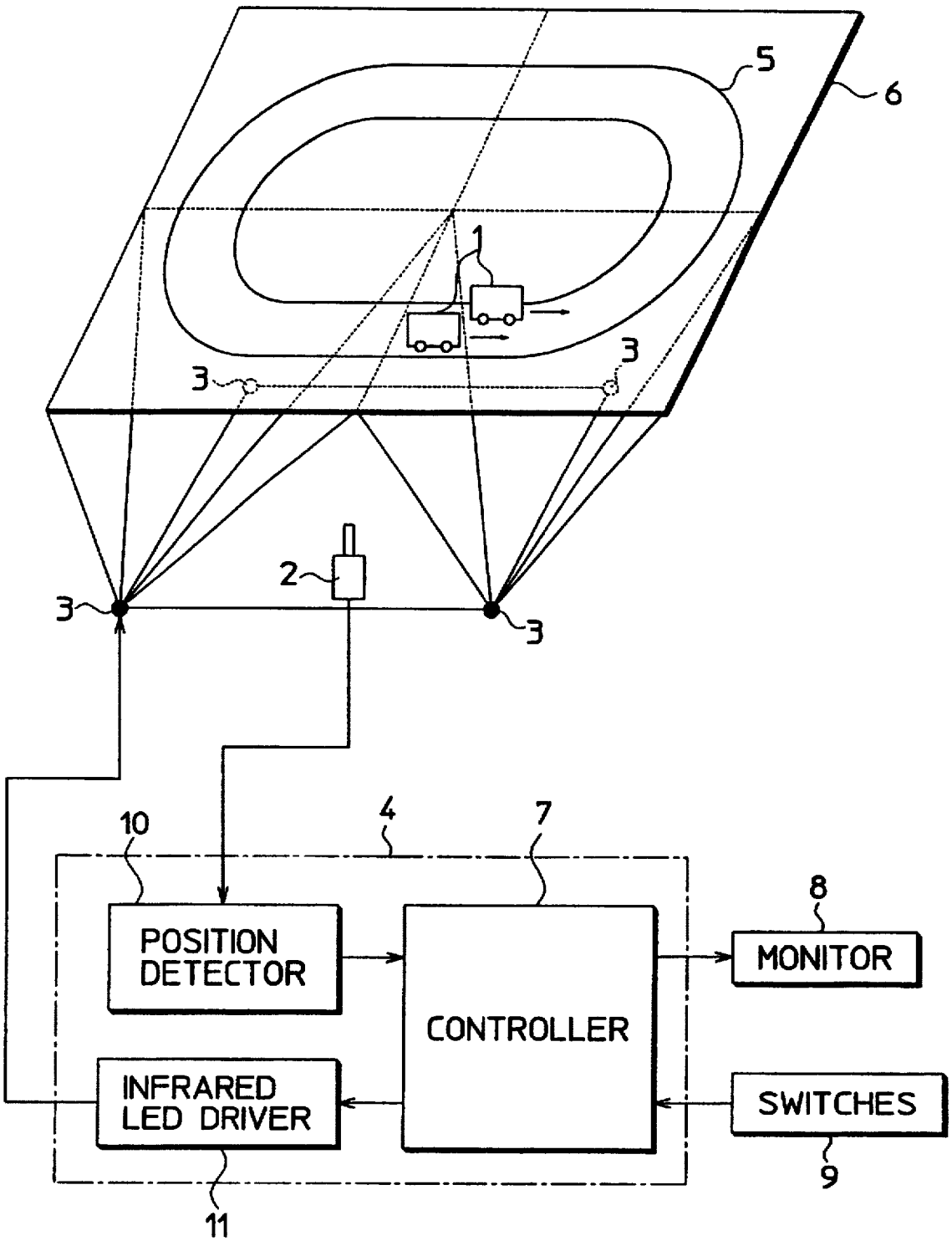
FIG. 1 is a perspective view of an entire race game machine as one embodiment of the invention.

FIG. 1 is a perspective view of an entire race game machine as one embodiment of the invention. The game machine is provided with a plurality of running bodies 1 (only two running bodies are shown) as movable objects, a CCD camera 2 as an area sensor, transmission LEDs 3 as a transmission means, and a main body 4. Wheels are mounted at front and rear parts of each running body 1 which runs on a circuit-simulating base 6. A race track 5 is drawn on the upper surface of the base 6.

The main body 4 includes a controller 7, a position detector 10 disposed between the CCD camera 2 and the controller 7, and an infrared LED driver 11 disposed between the controller 7 and the transmission LED The controller 7 centrally controls an entire operation of the game machine according to this embodiment and is provided internally with a computer (microcomputer), a ROM for storing a game program, a course data, necessary parameters, etc. in advance, and a RAM for temporarily storing a data being calculated and storing necessary parameters. The controller 7 is also provided with a built-in timer. The construction of the controller 7 is described later with reference to FIG. 3.

The course data includes position data successively stored at specified intervals on an arbitrary course on the race track 5 drawn on the base 6. In the case of a plurality of running bodies 1 as in this embodiment, there are prepared course position data so as to correspond to the respective running bodies 1. The controller 7 comprehends parameters set for each running body 1 as described later, and transmits to the running body 1 a run control signal in conformity with the course data set for the running body 1 in accordance with those parameters and the present position of the running body 1. Since the race development changes in real time according to the parameters as described later in this embodiment, no predetermined race development is stored in the ROM.

A monitor 8 and switches 9 are connected with the main body 4. Though one pair of the monitor 8 and the switches 9 are shown in FIG. 1, they are actually provided as many as maximum simultaneously playable players. One pair of the monitor 8 and the switches 9 are arranged on one operation panel, so-called control panel, so that one player can visually confirm and operate. Information necessary for the player to conduct the game such as odds and race results are displayed on the monitor 8. The player operates the switches 9 in order to input his bet on his predicted winning car.

Though unillustrated in FIG. 1, the game machine has a (generally known construction including, e.g. an odds calculating device, a medal insertion slot, a medal detector, a detector for detecting whether the player has input his bet, a discriminator for discriminating whether the player has betted on the winning car, a device for calculating how many medals are to be paid to the player who made a correct bet, and a device for paying a corresponding number of medals to the player.

In the case that there is provided one CCD camera 2, it is disposed substantially in the middle of the base 6 and at a specified height below the base 6 such that its sensing surface is directed upward and the substantially entire lower surface of the base 6 falls within its view frame. Accordingly, the base 6 is a plate member of glass or like transparent material. The running body 1 is sensed by the CCD camera 2 through the base 6. In consideration of the view frame of the CCD camera 2, the base 6 preferably has a square or circular shape. However, the base 6 may have a shape corresponding to that of the race track 5 or take a variety of other shapes depending on the kind of the game.

As already known, the CCD camera 2 is such that a plethora of photodetectors which are solid-state photoelectric conversion elements are arranged in a matrix. For example, if the scanning cycle of the CCD camera 2 is selectable between 1/60 sec. per field and 1/30 sec. per frame, an image is picked up using 1 field as a scanning cycle. The CCD camera 2 outputs an electrical (image) signal having a converted level corresponding to an amount of rays received by the respective photodetectors.

An infrared transmission filter is disposed on a light receiving surface of the CCD camera 2 adopted in this embodiment so that the CCD camera 2 receives only the infrared rays within a specified frequency band. In this way, an erroneous operation caused by external light is prevented. In place of the single CCD camera 2, a plurality of CCD cameras may be used. In such a case, the lower surface of the base 6 is divided into a plurality of areas, and images of the respective areas are picked up by the respective CCD cameras. With this arrangement, an image resolving power, i.e. a position detection accuracy can be improved.

The position detector 10 includes a frame memory in which the image signal from the CCD camera 2 is written, and an image processor for reading the content of the frame memory, detecting the position of the running body 1, and outputting coordinates of the detected position in the form of a detection signal.

In this embodiment, the detection is performed in real time, more accurately, repeatedly at intervals of a very short period. Accordingly, in order to perform the image signal writing operation and the image signal reading operation in a parallel manner, there are provided two frame memories each having a storage capacity of 1 frame. The write only frame memory and the read only frame memory are switched in accordance with a switch signal from the image processor.

A technique for detecting the position of the running body 1 which is adopted by the image processor may be suitably chosen from known image processing techniques. Since two LEDs 118, 119 are loaded in the running body 1 as described hereinafter in this embodiment (See FIG. 2), an exemplary technique may be such that a suitable threshold value is set for the signal level of the image signal to convert the image into a binary data, and the position of a luminescent spot in the image is detected by means of pattern matching, labeling or the like.

The transmission LEDs 3 are light emitting elements for emitting, e.g. infrared rays. Similar to the CCD camera 2, the transmission LEDs 3 are disposed at a specified height below the base 6 such that they emit light upward. An infrared signals from the transmission LEDs 3 are transmitted toward the running bodies 1 running on the race track 5 over a specified angle. A single transmission LED may be disposed in the center portion but, in order to more securely transmit the signal, it is better to divide the base 6 into a plurality of areas and to cover the two or more areas with a corresponding number of transmission LEDs 3. In this embodiment, four transmission LEDs 3 are arranged to cover four areas of the base 6.

The transmission LEDs 3 are connected in parallel with the LED driver 11 which controllably drives the transmission LEDs 3 in accordance with a turn-on command signal from the controller 7 so that the transmission LEDs 3 transmit specified infrared pulse signals. The turn-on command signal is used to turn on the respective transmission LEDs 3. In the game machine in which a plurality of transmission LEDs 3 are provided, the LED driver 11 controllably drives the transmission LEDs 3 such that the transmission LEDs 3 connected in parallel with one another transmit synchronized optical pulse signals. Thus, even if the areas covered by the transmission LEDs 3 partly overlap, no interference occurs, thereby preventing an erroneous operation.

Besides the above connection, the transmission LEDs 3 may be serially connected, which has an advantage of a simple construction. Further, in order to suppress the influence of impedance and generation of noises, the transmission LEDs 3 may be serially connected each via a driver (using a shielded lines). Compared with the serial connection, the parallel connection has an advantage of less influence of impedance.

Figure 2:
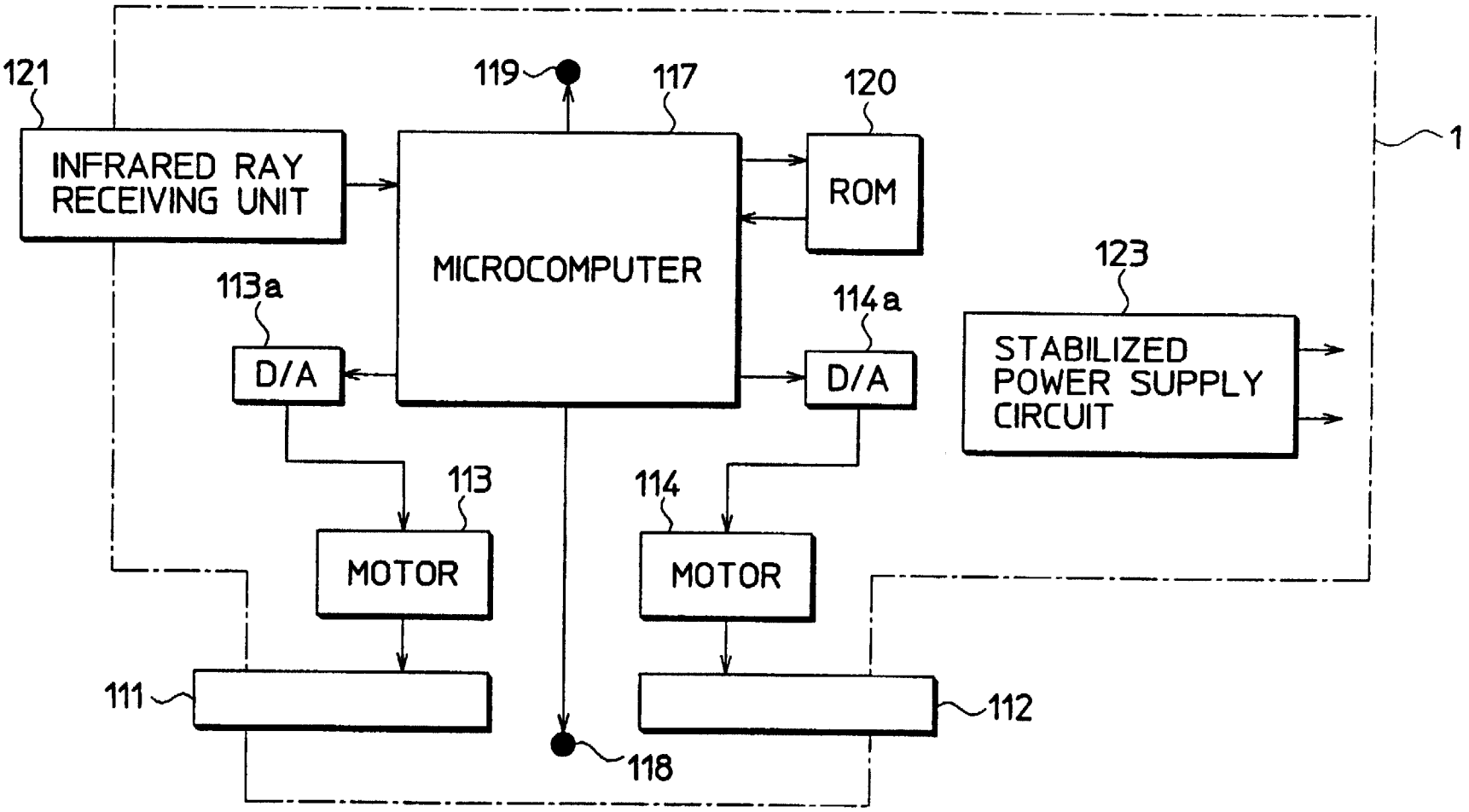
FIG. 2 is a block construction diagram of a running, body when viewed from above.

FIG. 2 is a block construction diagram of the running body when viewed from above.

The running body 1 has an unillustrated main body and includes a pair of drive wheels 111, 112 rotatably disposed at the left and right sides of its front portion and an unillustrated spherical member (ball or caster) disposed in the middle of its rear (or front) portion. In this way, the running body 1 is supported in three points. The spherical member is fitted into a partly spherical hole formed in the lower surface of the running body 1 such that more than half thereof is volumetrically accommodated therein. The spherical member is rollable in every direction. By having a three-point support structure, the running body 1 is enable to effectively simulate a slipping movement. In place of the spherical member, rotatable wheels may be disposed at the left and right sides of the rear portion of the running body 1.

The running body 1 includes motors 113, 114 for drivingly rotating the wheels 111, 112 of a resin or like material. In this embodiment, DC motors are used as the motors 113, 114 so that the speed of the running body 1 can be duty-controlled and the running body 1 can run backward (by inversion of polarity of a supply current) if necessary. Alternatively, pulse motors may be used so as to enable a speed control using a pulse frequency. Reduction gears are provided in a plurality of stages between rotatable shafts of the motors 113, 114 and those of the drive wheels 111, 112 to ensure a specified speed range.

Indicated at 117 is a one-chip microcomputer as a controller of the running body 1. The microcomputer 117 analyzes signals transmitted from the transmission LED 3 of the main body 2 to generate a run control signal for the running body 1, and causes front and rear LEDs 118, 119 for emitting infrared rays. A ROM 120 is adapted to store an operation program of the microcomputer 117. Indicated at 113*a*, 114*a* are amplifiers for amplifying the speed control signal output from the microcomputer 117 and sending the amplified signal to the motors 113, 114.

The front and rear LEDs 118, 119 are disposed at a front center portion and at a rear center portion of the running body 1 such that they are both directed right downward. A frequency band of the infrared rays emitted when the front and rear LEDs 118, 119 are turned on corresponds with a transmission frequency band of the infrared transmission filter provided on the front surface of the CCD camera 2. The infrared rays having passed through the infrared transmission filter are sensed by the CCD camera 2 disposed below. The LEDs 118, 119 are fabricated such that the rays propagate over a wide angle. The rays can be sensed by the CCD camera 2 in any arbitrary position on the base 6.

Indicated at 121 is an infrared ray receiving unit which includes a photodiode or the like for receiving optical pulse signals transmitted from the transmissions LEDs 3. The unit 121 is so disposed as to face, e.g. downward at the center bottom portion of the running body 1 . The unit 121 is, for example, exposed so as to receive the rays over a wide range. Indicated at 123 is a stabilized power supply circuit for generating voltages from a supply voltage supplied from an external power source such as a voltage of 5 V necessary to operate the microcomputer 117 and a voltage of 6 V necessary to operate the motors 113, 114.

Figure 3:
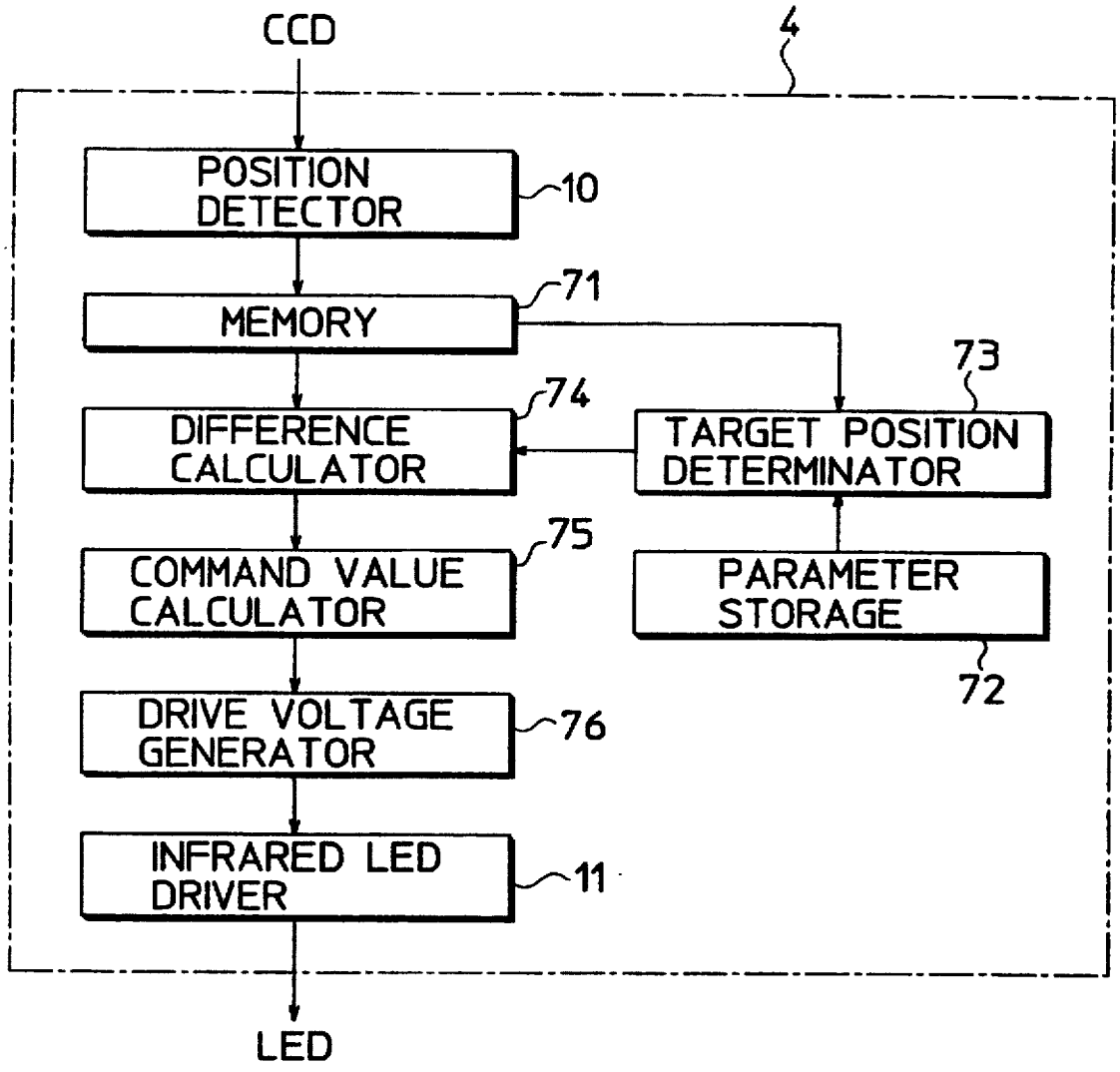
FIG. 3 is a function block diagram of a controller.

FIG. 3 is a function block diagram of the controller 7. In FIG. 3, indicated by 71 is a memory for temporarily storing a coordinates signal representative of the coordinates of the luminescent points (corresponding to the front and rear LEDs 118, 119 of the running body 1) output from the position detector 10. In the case that a plurality of running bodies 1 simultaneously run as in this embodiment, addresses in which the coordinates of the luminescent points of the respective running bodies 1 are stored are predetermined, and new coordinates are renewably written each time the coordinates of the corresponding luminescent points are output from the position detector 10.

Indicated at 72 is a parameter storage for storing parameters used to determine target positions of the running bodies 1 and the aforementioned course data. The parameters are described in detail later. Indicated at 73 is a target position determinator for determining the target positions of the respective running bodies 1 in accordance with the coordinates of the luminescent points of the running bodies 1 which are stored in the memory 71, and the parameters and the course data both of which are stored in the parameter storage 72. The determination of the target positions is also described later.

Indicated at 74 is a difference calculator for calculating a difference between a present position represented by the coordinates of the luminescent points of each running body 1 which is stored in the memory 71 and the target position of this running body 1 determined by the target position determinator 73. Indicated at 75 is a command value calculator for calculating a command value used to drive each running body 1 in such a direction as to make the difference 0, i.e. to drive each running, body 1 toward its target position in accordance with the difference of each running body 1 calculated by the difference calculator 74. The command value includes a target speed and a steering angle of each running, body 1.

Indicated at 76 is a drive voltage generator for converting the command value into a specified command represented by a combination of optical pulse signals and outputting as a voltage pulse signal. The voltage pulse signal is input to the infrared LED driver 11, which in turn drives the respective transmission LEDs 3 in accordance therewith. Tables 1 and 2 show in detail parameters stored in the parameter storage 72 of the controller 7.

TABLE 1

| | Control Parameters | Reference Parameters |
|---|---|---|
| Before Race | Standard Speed | Horsepower, Torque |
| | Instantaneous Force | Horsepower, Torque |
| | Initial Body Weight | Initially Loaded Gas Amount |
| During Race | Speed | Standard Speed, Instantaneous Force, Initial Body, Mileage, Speed Command |

TABLE 2

| | Control Parameters | Reference Parameters |
|---|---|---|
| Before Race | Degree of Command Transmission | Skill, Road Condition, Race Pattern, Course Layout, Driver's Condition |
| During Race | Degree of Command Transmission | Skill, Road Condition, Race Pattern, Course Layout, Driver's Condition Degree of Fatigue |
| | Speed Command | Race Pattern, Positions of Nearby Running Bodies |
| | Direction Command | Race Pattern, Positions of Nearby Running Bodies |

In this embodiment, there are provided running body parameters relating to the running body 1 and driver parameters relating to a virtual driver driving the running body 1. The running body parameters vary with the driver parameters. The running body parameters and the driver parameters are roughly divided into those determined before the race (classified as "before race" in Tables 1 and 2) and those variable during the race (classified as "during race" in Tables 1 and 2). Further, the "before race" parameters and the "during race" parameters are roughly divided into control parameters and reference parameters. The control parameters shown in Tables 1 and 2 vary with the reference parameters listed on the right side.

Table 1 shows the running body parameters. The contents of the respective parameters are briefly described. A control parameter "standard speed" in the first row represents a standard speed at which the running body 1 runs during the race and is determined before the start of the race in accordance with reference parameters "horsepower" and "torque". The reference parameters "horsepower" and "torque" are peculiar to each running body 1.

A control parameter "instantaneous force" in the second row determines the degree of acceleration when an acceleration command is given to the running body 1 and is, similar to the control parameter "standard speed", determined before the start of the race in accordance with reference parameters "horsepower" and "torque."

A control parameter "initial body weight" in the third row represents a weight of the running body 1 before the race, and is determined before the start of the race in accordance with a reference parameter "initially loaded gas amount" which is also peculiar to each running body 1.

A control parameter "speed" in the fourth row represents a speed command value of each running body 1 during the race, and is determined in accordance with the reference parameters "standard speed", "instantaneous force", "speed command", "initial body weight" and "mileage." For example, the parameter "speed" may be obtained by adding a speed increase or decrease to the "standard speed". The speed increase or decrease is calculated in accordance with the reference parameters "speed command" and "instantaneous force." The reference parameter "instantaneous force" varies with a multiple of the reference parameter "mileage" by a lapse of time after the start of the race and the reference parameter "initial body weight."

Table 2 shows the driver parameters. A control parameter "degree of command transmission" is a probability variable representing to what degree a command from the driver is transmitted to the running body 1, and takes a value between 0 and 1. The command from the driver is transmitted to the running body 1 in accordance with a given probability specified by the "degree of command transmission," and the speed and steering of the running body 1 are controlled. The control parameter "degree of command transmission" is determined in accordance with reference parameters "skill", "road condition", "race pattern", "course layout", and "driver's condition".

The values of the reference parameters "skill" and "race pattern" are peculiar to each running body 1 (accurately, peculiar to the driver driving the running body 1). More specifically, the reference parameter "race pattern" represents which race development the driver tries to attain and may, for example, be specific values representative of "hold the lead from the beginning to the end of the race" and "take chances in the latter half of the race". The reference parameter "road condition" has values peculiar to the race to be described later, and has specific values representative of "fine", "cloudy", "rainy", "daytime", and "night". The reference parameters "driver's condition" represents a present condition of each driver which is classified into "best possible condition", "good condition" and "bad condition" before the start of the race.

A control parameter "degree of command transmission" in the second row is substantially similar to that in the first row, but has an additional reference parameter "degree of fatigue." The reference parameter "degree of fatigue" increases as the race elapses and a rate of increase is peculiar to each driver.

A control parameter "speed command" in the third row represents an acceleration or deceleration command to each running body 1, and is determined in accordance with the reference parameters "race pattern" and "positions of the nearby running bodies". The reference parameter "positions of the nearby running bodies" represents whether or not there are other running bodies around the that running body 1 (before, after, on the left, and on the right of the running body 1), and is calculated and determined in real time during the race in accordance with the output from the position detector 10. For instance, if there is a space in front which permits one running body 1 to pass when the driver is presently strong-minded (e.g. the race pattern "hold the lead from the beginning to the end of the race" immediately after the start of the race), the parameter "speed command" takes a value representative of acceleration. On the contrary, if there is another running body in front when the driver is presently weak-minded (e.g. the race pattern "take chances in the latter half of the race" immediately after the start of the race), the parameter "speed command" takes a value representative of deceleration.

A control parameter "direction command" in the third row is a running direction command for each running body 1 (straight forward, change the course to the left, and change the course to the right), and is determined in accordance with the reference parameters "race pattern" and "positions of nearby running bodies." For instance, if there is a space in front which permits one running body 1 to pass when the driver is presently strong-minded, the parameter "direction command" takes a value representative of steering toward the space.

Figure 4:
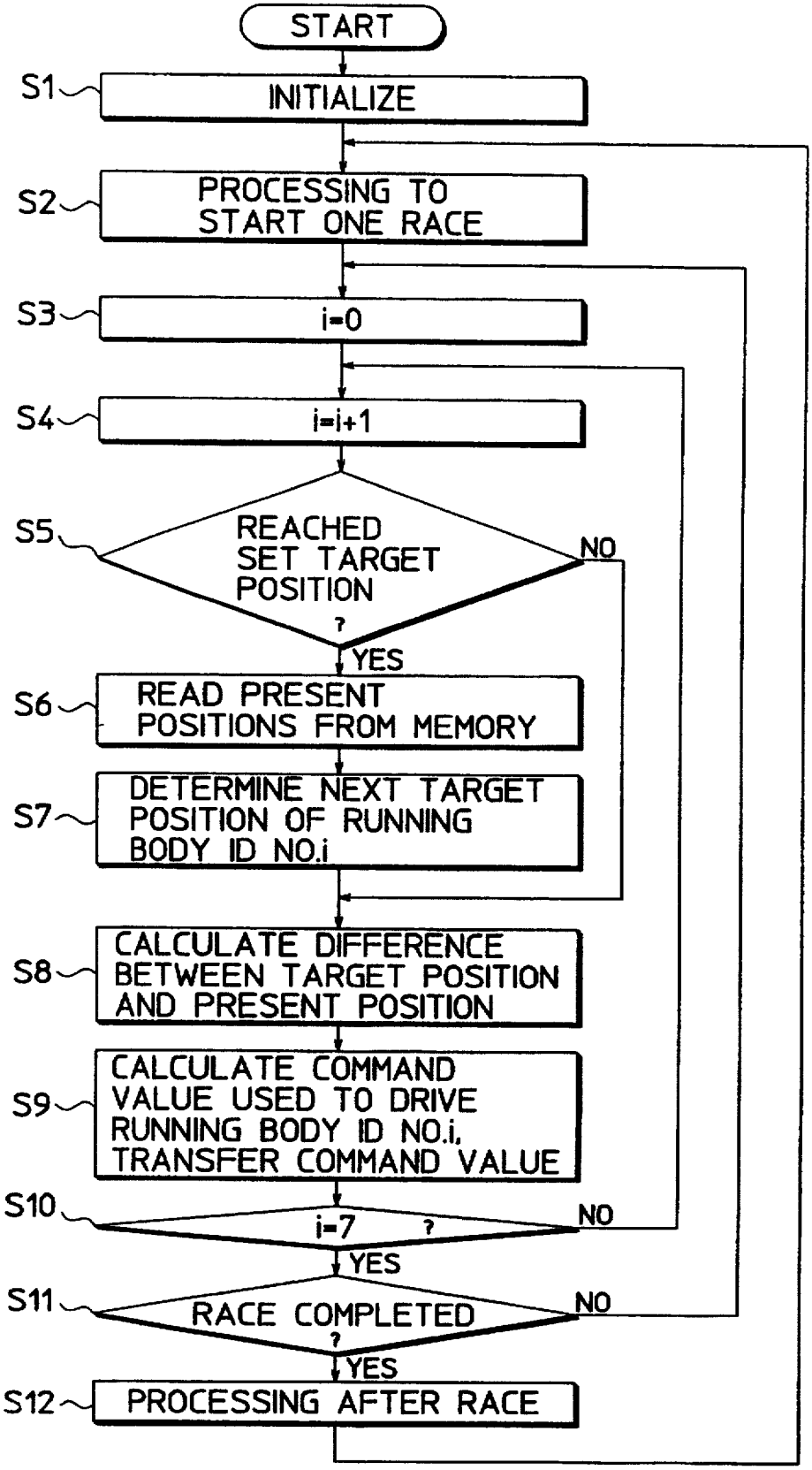
FIG. 4 is a flowchart showing an operation of the race game machine.

Next, with reference to a flowchart of FIG. 4, the operation of the race game machine according to this embodiment is described. In this game machine, there are used, e.g. 8 running bodies 1 to which identification (ID) Nos. i (i=0 to 7) are given as specific numbers by setting dip switches provided in the running bodies 1.

The program shown in the flowchart of FIG. 4 starts when a power switch of the unillustrated game machine main body 2 is turned on. In Step S1, the entire system is initialized, resetting values of the respective parameters and initializing communication ports of the controller 7.

In Step S2, a processing is performed to start one race. Specifically, after determining the virtual drivers who are going to drive the respective running bodies 1, a game start screen image and an odds screen image are displayed on the monitors 8 of the players. It is waited on standby until the players input their bets by means of the switches 9. Thereafter, the running bodies 1 are moved to a start line drawn in a specified position of the race track 5, and the initial positions thereof along the start line are detected.

Then, a specific course data is selected from a plurality of course data stored in the parameter storage 72, and parameters ("road condition", "driver's condition", etc.) which are determined for each race are determined. Thereafter, the target positions of the respective running bodies 1 immediately after the start of the race are determined by the target position determinator 73 in accordance with the thus determined parameters and the detected initial positions of the running bodies 1. For example, the target positions may be positions the running bodies 1 reach 1 sec. after the start of the race.

Upon determination of the target positions, the differences between the target positions and the present positions of the running bodies are calculated by the difference calculator 74, and command values are output to the running bodies 1 in accordance with the calculated differences. The command values are converted, by the drive voltage generator 76 and the infrared LED driver 11, into signals used to drive the transmission LEDs 3. As a result, the infrared pulse signals corresponding to the command values are transmitted from the transmission LEDs 3 to the running bodies 1.

The speed and direction of each running body 1 are instructed in accordance with only a target speed data. More specifically, the speed command is given to, e.g. the motor 113 for driving the wheel 111 on one specific side, and the direction command is given in the form of a speed difference with respect to a rotating speed of the motor 113 on the specific side. The direction of the running body 1 may be similarly controlled by independently instructing the rotating speed to the respective motors 113, 114.

When the infrared ray receiving unit 121 of the running body 1 receives the infrared pulse signal from the transmission LEDs 3, the microcomputer 117 analyzes this signal; calculates the command value; and sends a signal to the motors 113, 114 so as to drive the motors 113, 114 at specified rotating speeds corresponding to the command value.

In Step S3, a counter i indicating the ID No. of the running body is reset and then the value of the counter i is incremented by one in Step S4.

In Step S5, the present position of the running body 1 having an ID No. corresponding to the value of the counter i is read from the memory 71. As described above, the position detector 10 detects the present positions of the respective running bodies 1 at intervals of a very short period (i.e. to the extent that it is substantially considered to make a detection in real time), and latest present positions of the running bodies 1 are constantly stored in the memory 71. In accordance with the read present position of the running body 1 having ID No. i, it is discriminated whether this running body 1 has reached the set target position. Step S6 follows if the discrimination result is in the affirmative, while Step S8 follows if it is in the negative.

In Step S6, necessary parameters are read from the parameter storage 72 and the present positions of the running bodies 1 around the running body 1 having ID No. i are read from the memory 71. In Step S7, a next target position of the running body having ID No. i is determined by the target position determinator 73 in accordance with the parameters read in Step S6 and the present positions of the running bodies 1 around this running body 1. Step S7 is described in more detail later.

In Step S8, a difference between the target position determined in Step S7 and the present position of the running body 1 having ID No. i read in Step S5 is calculated by the difference calculator 74. Further in Step S9, a command value used to drive the running body having ID No. i to the target position determined in Step S7 is calculated by the command value calculator 75. Thereafter, the command value is transferred to the drive voltage generator 76 and output to the running body 1 as an infrared pulse signal by the infrared LED driver 11. The running of the running body 1 having ID No. i is controlled by this infrared pulse signal.

In Step S10, it is discriminated whether the value of the counter i is equal to 7, i.e. whether the target positions were calculated and the command values were transmitted for all eight running bodies 1. If the counter value is smaller than 7, this routine returns to Step S4 and the above operation is repeated for the next running body 1. If the counter value is equal to 7, Step S11 follows.

In Step S11, it is discriminated whether the race has been completed. Step S12 follows if the discrimination result is in the affirmative, while Step S3 follows to control the running of the running, body 1 having ID No. 0 again if the discrimination result is in the negative. In Step S12, processings after the race are performed. Specifically, which running, body has won the race is determined and displayed, and the player(s) who made a correct bet is/are paid.

Figure 5:
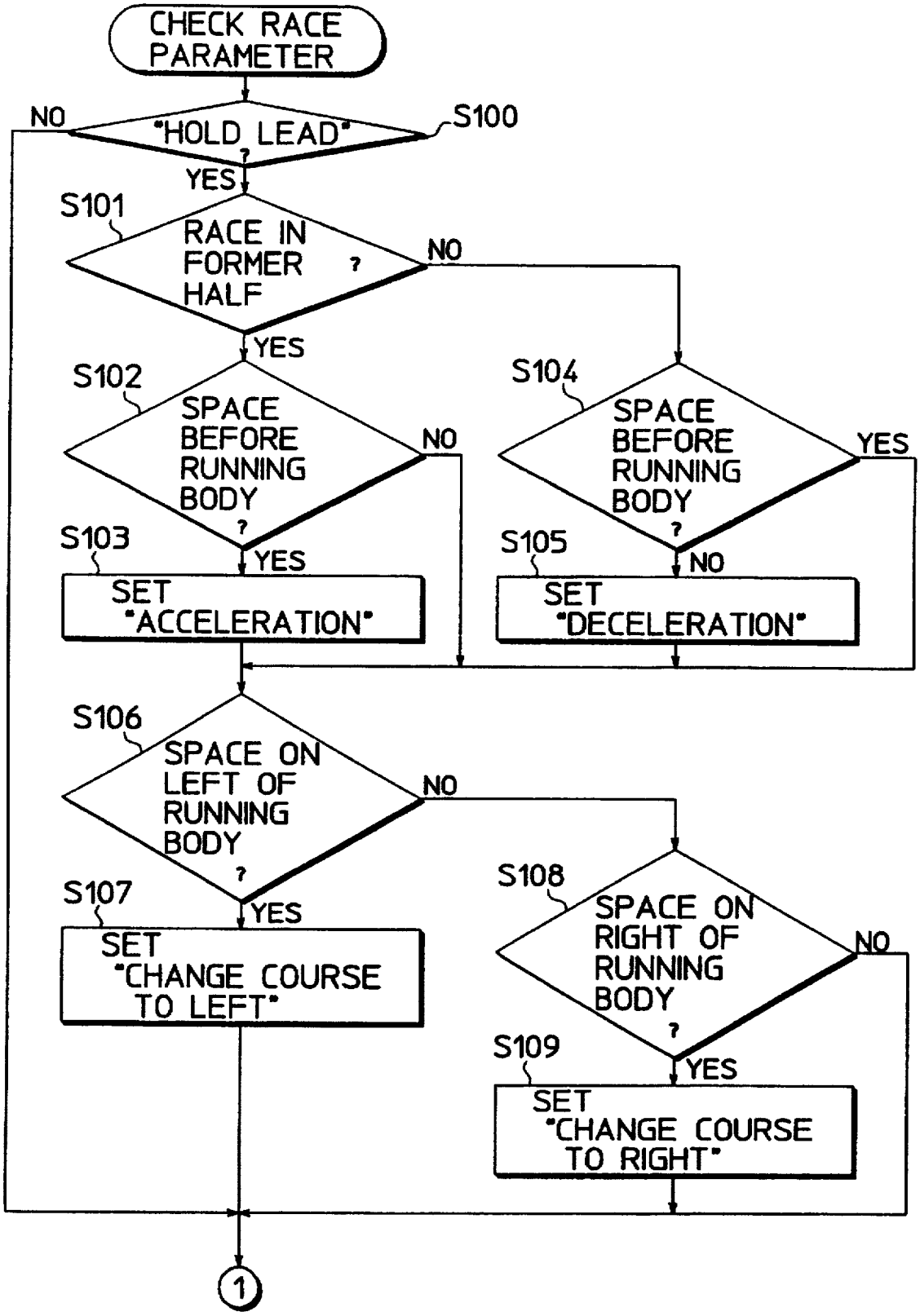
FIGS. 5 and 6 are flowcharts showing a subroutine "Target Position Calculation".
Figure 6:
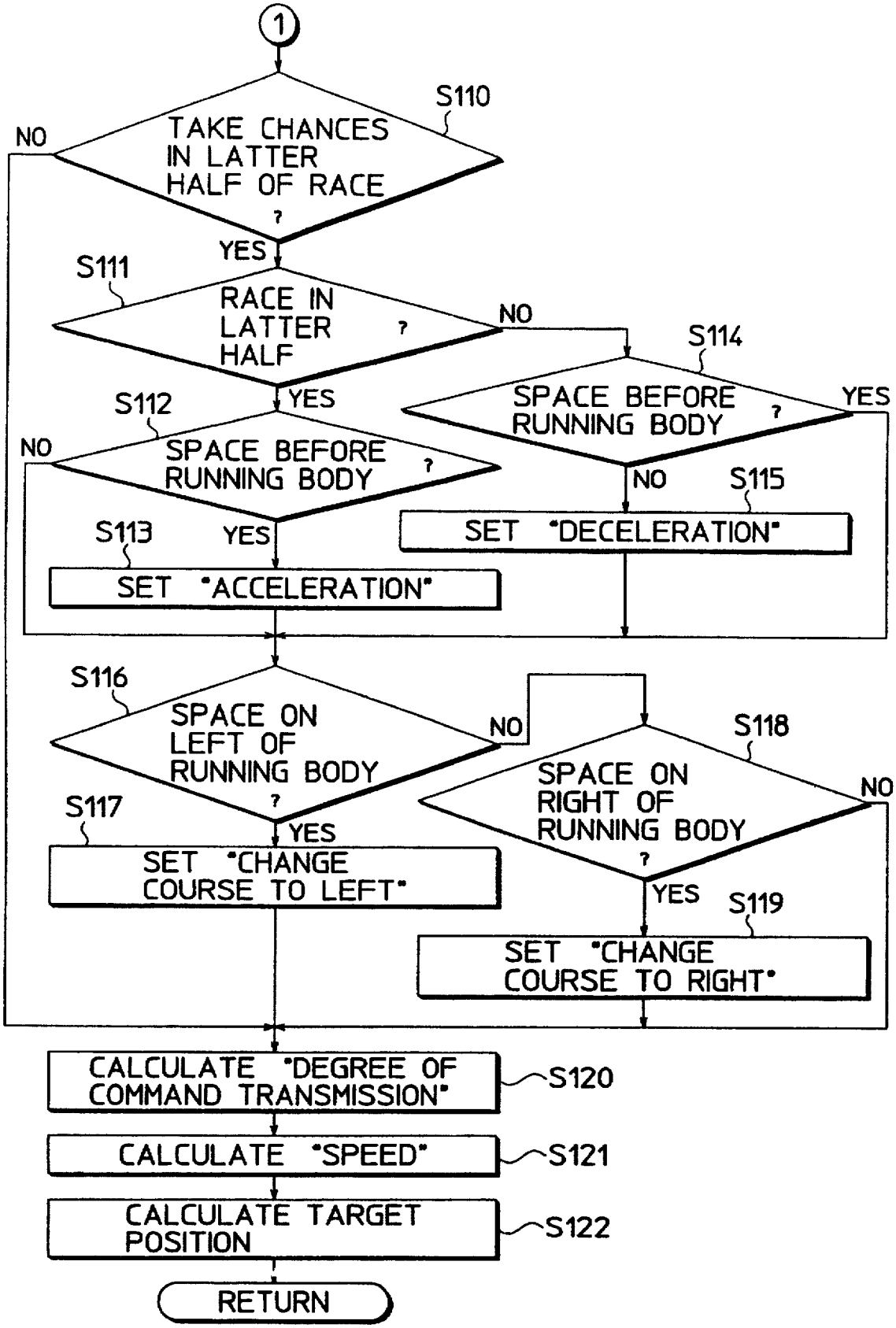

FIGS. 5 and 6 are flowcharts showing a subroutine "Target Position Calculation" performed in Step S7 of the flowchart of FIG. 4.

First, in Step S100, the race pattern parameter of the running body I having ID No. i is checked to discriminate whether it represents "hold the lead from the beginning to the end of the race." Step S101 follows if the discrimination result is in the affirmative, while Step S110 follows if it is in the negative. In Step S101, it is discriminated whether the race is presently in its former half. Step S102 follows if the discrimination result is in the affirmative, while Step S104 follows if it is in the negative.

In Step S102, it is discriminated whether there is a space, before the running body 1 having ID No. i, which permits one running body to pass. If there is a space, the speed command parameter is set at a value representative of "acceleration" in Step S103 upon judging to pass over the running body in front in order to hold the lead during the former half of the race. If there is discriminated to be no space in Step S102, Step S106 follows upon judgment that it is impossible to pass over the running body in front.

In Step S104, it is discriminated whether there is a space, before the running body 1 having ID No. i, which permits one running body to pass. If there is no space, the speed command parameter is set at a value representative of "deceleration" in Step S105 upon judging to pace down because the race is in its latter half. If there is discriminated to be a space in Step S104, Step S106 follows.

In Step S106, it is discriminated whether there is a space, on the left of the running body 1 having ID No. i, which permits one running body to pass. If there is a space, the direction command parameter is set at a value representative of "change the course to the left" in Step S107 upon judging to pass over the running body in front in order to hold the lead. If there is discriminated to be no space in Step S106, Step S108 follows.

In Step S108, it is discriminated whether there is a space, on the right of the running body 1 having ID No. i, which permits one running body to pass. If there is a space, the direction command parameter is set at a value representative of "change the course to the right" in Step S109 upon judging to pass over the running body in front in order to hold the lead. If there is discriminated to be no space in Step S108 (in this case, there is no space which permits a course change either on the left side or on the right side), Step S110 of FIG. 6 follows.

With reference to FIG. 6, in Step S110, the race pattern parameter of the running body 1 having ID No. i is checked to discriminate whether it represents "take chances in the latter half of the race." Step S111 follows if the discrimination result is in the affirmative, while Step S120 follows if it is in the negative. In Step S110, it is discriminated whether the race is presently in its latter half. Step S112 follows if the discrimination result is in the affirmative, while Step S114 follows if it is in the negative.

In Step S112, it is discriminated whether there is a space, before the running body 1 having ID No. i, which permits one running body to pass. If there is a space, the speed command parameter is set at the value representative of "acceleration" in Step S113 upon judging to pass over the running body in front in order to take chances in the latter half of the race. If there is discriminated to be no space in Step S112, Step S116 follows upon judgment that it is impossible to pass over the running body in front.

In Step S114, it is discriminated whether there is a space, before the running body 1 having ID No. i, which permits one running body to pass. If there is no space, the speed command parameter is set at the value representative of "deceleration" in Step S115 upon judging to pace down because the race is in its former half. If there is discriminated to be a space in Step S114, Step S116 follows.

In Step S116, it is discriminated whether there is a space, on the left of the running body 1 having ID No. i, which permits one running body to pass. If there is a space, the direction command parameter is set at the value representative of "change the course to the left" in Step S117 upon judging to pass over the running body in front in order to take chances. If there is discriminated to be no space in Step S116, Step S118 follows.

In Step S118, it is discriminated whether there is a space, on the right of the running body 1 having ID No. i, which permits one running body to pass. If there is a space, the direction command parameter is set at the value representative of "change the course to the right" in Step S119 upon judging to pass over the running body in front in order to take chances. If there is discriminated to be no space in Step S118 (in this case, there is no space which permits a course change either on the left side or on the right side), Step S120 follows.

In Step S120, the value of the parameter "degree of command transmission" is calculated in accordance with the values of the parameters "skill", "road condition", "race pattern", "driver's condition", "degree of fatigue" corresponding to the running body 1 having the ID No. i. If the above parameters take values as follows:

Skill:

0.5 to 1 (peculiar to each running body)

Road Condition:

fine=1, cloudy=0.9, rainy=0.6, daytime=1, night=0.7

Race Pattern:

hold the lead from the beginning to the end of the race (former half=1, latter half=0.8)

take chances in the latter half of the race (former half=0.8, latter half=1)

Driver's Condition:

best possible condition =1, good condition=0.9, bad condition=0.6,

Degree of Fatigue:

a multiple of a value peculiar to each running body by a lapse of the race, the value of the parameter "degree of command transmission" can be calculated in accordance with the following equation:

$$\text{Degree of Command Transmission}=\text{Skill}\times\text{Road Condition}\times\text{Race Pattern}\times\text{Driver's Condition}\times(1-\text{Degree of Fatigue}).$$

Next, in Step S121, the value of the parameter "speed" is calculated in accordance with the values of the parameters "standard speed", "instantaneous force", "initial weight", "mileage", "speed command"corresponding to the running body 1 having ID No. i. For instance, if the above parameters take values as follows:

Instantaneous Force: 0.4 to 1 (peculiar to each running body)

Initial Weight: 0.8 to 1.2 (peculiar to each running body)

Mileage: 0.7 to 1.3 (peculiar to each running, body)

Speed Command: Acceleration=1, Deceleration=−1, the value of the parameter "speed" can be calculated in accordance with the following equation: Speed=Standard Speed+Speed Command×Constant×(Instantaneous Force×(1−(Initial Weight−Constant ×Mileage))).

In Step S122, the target position of the running body 1 having ID No. i is calculated. The target position is basically set at a position away from the present position of the running body 1 by a distance which the running body 1 runs during a specified period (e.g., 1 sec. ). If the direction command parameter is set at either "change the course to the left" or "change the course to the right", the target position is deviated to the left or right by a specified distance.

As described above, the running control for the respective running bodies 1 are such that the parameters corresponding thereto are changed each time they reaches their target positions and next target positions are determined in accordance with the changed parameters. Accordingly, the number of race developments performable in the race game machine according to this embodiment in actuality approximates to infinity. Thus, even if a player repeatedly plays the game, he cannot perfectly predict the race development, with the result that the game remains interesting over a long term. In addition, even if any of the running bodies 1 is temporarily brought into an uncontrollable state due to a mechanical or electrical trouble, this running body 1 can participate the race again by determining the parameters corresponding to this running body 1 after it is brought back into a controllable state again. Therefore, according to this embodiment, a system having an excellent restorability against a trouble can be provided.

The race game machine according to the invention is not limited to the detail of the foregoing embodiment, but may be modified in a variety of manners. For examples, although the running bodies themselves run on the race track 5 in the foregoing embodiment, the invention is applicable to such race game machines that movable object simulating racing cars, racing horses or the like disposed on the race track 5 run as the running bodies disposed below the race track 5 run.

The parameters described in the foregoing embodiment are nothing but examples. The game may be conducted using a smaller number of parameters than the described parameters or using different parameter(s). It should be appreciated that parameters to be used change depending, upon the kind of the game.

Without being limited to the foregoing embodiment, the race game machine according to the invention is applicable to any race game machine including movable objects whose movements are controlled in accordance with commands from the game machine main body. For example, although the running bodies can freely run on the race track 5 in the foregoing embodiment, the invention may be applied to race game machines including movable objects which can run along predetermined tracks. In such a case, the game machine main body may control the speed of the movable objects.

As described above, according to the invention, the target positions of the respective movable objects are calculated at intervals of the predetermined period in accordance with the parameter stored in the parameter storage means, and the movable objects are controllably moved toward their target positions. Accordingly, the race development can be successively changed by changing the value of the parameter. Thus, the number of race developments performable in the race game machine according to the invention in actuality approximates to infinity. Therefore, even if a player repeatedly plays the game, he cannot perfectly predict the race development, with the result that the game remains interesting over a long term. In addition, even if any of the movable objects is temporarily brought into an uncontrollable state due to a mechanical or electrical trouble, this movable object can participate the race again by determining the parameters corresponding thereto after it is brought back into a controllable state again. Therefore, according to the invention, a system having an excellent restorability against a trouble can be provided.

Further, since the target positions of the movable objects are calculated in accordance with the present positions thereof, the number of race developments realizable in this race game machine according to the invention can be increased.

Furthermore, since the target position of the specific movable object is calculated in accordance with the positions of the plurality of movable objects located around the specific movable object, there can be realized, for example, such a running control that, if there is a space before the specific movable object which permits it to pass, the specific movable object passes through this space. This leads to far more race developments and realization of race developments truly analogous to an actual race.

Further, since the values of the parameters are determined for each race, the race development is determined based on the determined values of the parameters. Thus, the race development can be changed for each race, thereby making the game more interesting Furthermore, since the values of the parameters are determined at intervals of the specified period, they are successively determined during the race, thereby enabling the race development to be changed during the race and, therefore, making the game more interesting.

Although the present invention has been fully described by ay of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A race game machine comprising:

a race track;

a plurality of running bodies physically engaged in competitive movement along said race track;

a parameter storage device which stores at least one parameter used to control said competitive movement of each of said plurality of running bodies;

a target position calculation device which, at intervals of a predetermined period during a duration of the race, calculates target positions of respective ones of said running bodies in accordance with said at least one parameter stored in said parameter storage device; and a movement control device which controls said competitive movement of said plurality of running bodies toward corresponding ones of said target positions calculated by said target position calculation device.

2. A race game machine according to claim 1, further comprising:

a position detection device which detects the present positions of respective ones of said plurality of running bodies along said race track; and wherein said target position calculation device calculates said target positions of said running bodies at said intervals of a predetermined period in accordance with said present positions of said running bodies detected by said position detection device and said at least one parameter stored in said parameter storage device.

3. A race game machine according to claim 2, wherein said target position calculation device calculates said target position of a specific one of said plurality of running bodies in accordance with said present positions of a remainder of said plurality of running bodies located around said specific one of said plurality of running bodies.

4. A race game machine according to claim 2, wherein:

said movement control device includes a difference calculation device which calculates a difference between a particular one of said target positions corresponding to a respective one of said plurality of running bodies calculated by said target position calculation device and a corresponding one of said present positions of said respective one of said running bodies detected by said position detection device; and said movement control device controls said competitive movement of said respective one of said plurality of running bodies in such a direction as to reduce said difference calculated by said difference calculation device.

5. A race game machine according to claim 1, wherein a plurality of parameters are stored in said parameter storage device.

6. A race game machine according to claim 5, further comprising a first parameter value determination device which determines a value of at least one of the said plurality of parameters each time a new race is conducted.

7. A race game machine according to claim 5, further comprising a second parameter value determination device which determines a value of at least one of said plurality of parameters at intervals of a specified period.

8. A race game machine according to claim 1, wherein:

said movement control device includes a transmission device which transmits to each of said plurality of running bodies a control signal; and each of said plurality of running bodies includes a reception device which receives said control signal transmitted from said transmission device, and a drive device which drives each of said plurality of running bodies toward a corresponding one of said target positions in accordance with said control signal received by said reception device.

9. A race game machine according to claim 1, wherein:

said at least one parameter used to control said competitive movement includes at least one running body parameter, said at least one running body parameter having values related to a characteristic of respective ones of said plurality of running bodies.

10. A race game machine according to claim 1, wherein:

said at least one parameter used to control said competitive movement includes at least one driver parameter, said at least one driver parameter having values related to a characteristic of respective ones of a plurality of drivers assigned to drive corresponding ones of said plurality of running bodies.

11. A race game machine in which a race is conducted by competitive movement of a plurality of running bodies, independent of one another, along a race track, said race game comprising:

a parameter storage device which stores a plurality of parameters used to control said competitive movement of each of said plurality of running bodies;

a target position calculation device which, at intervals of a predetermined period during a duration of the race, calculates target positions of respective ones of said running bodies in accordance with said plurality of parameters stored in said parameter storage device;

a movement control device which controls said competitive movement of said plurality of running bodies toward corresponding ones of said target positions calculated by said target position calculation device; and said plurality of parameters including at least one before-race parameter which is determined before the race is started, and at least one during-race parameter variably determined during the race at intervals of a specified period.

12. A race game machine in which a race is conducted by competitive movement of a plurality of running bodies, independent of one another, along a race track, said race game comprising:

a parameter storage device which stores a plurality of parameters used to control said competitive movement of each of said plurality of running bodies;

a target position calculation device which, at intervals of a predetermined period during a duration of the race, calculates target positions of respective ones of said running bodies in accordance with said plurality of parameters stored in said parameter storage device;

a movement control device which controls said competitive movement of said plurality of running bodies toward corresponding ones of said target positions calculated by said target position calculation device; and said plurality of parameters including at least one control parameter and at least one reference parameter, said at least one control parameter varying as a function of said at least one reference parameter.

13. A race game machine in which a race is conducted by competitive movement of a plurality of running bodies, independent of one another, along a race track, said race game comprising:

a parameter storage device which stores a plurality of parameters used to control said competitive movement of each of said plurality of running bodies;

a target position calculation device which, at intervals of a predetermined period during a duration of the race, calculates target positions of respective ones of said running bodies in accordance with said plurality of parameters stored in said parameter storage device;

a movement control device which controls said competitive movement of said plurality of running bodies toward corresponding ones of said target positions calculated by said target position calculation device;

said plurality of parameters including at least one control parameter and at least one reference parameter, said at least one control parameter varying as a function of said at least one reference parameter;

said at least one control parameter including at least one of an initial body weight, a standard speed, an instantaneous force, acceleration, and speed during race; and said at least one reference parameter including at least one of a horsepower, a torque, initially loaded gas and an amount, an instantaneous force, said initial body weight, a milage, and a speed command.

14. A race game machine in which a race is conducted by competitive movement of a plurality of running bodies, independent of one another, along a race track, said race game comprising:

a parameter storage device which stores a plurality of parameters used to control said competitive movement of each of said plurality of running bodies;

a target position calculation device which, at intervals of a predetermined period during a duration of the race, calculates target positions of respective ones of said running bodies in accordance with said plurality of parameters stored in said parameter storage device;

a movement control device which controls said competitive movement of said plurality of running bodies toward corresponding ones of said target positions calculated by said target position calculation device;

said plurality of parameters including at least one control parameter and at least one reference parameter, said at least one control parameter varying as a function of said at least one reference parameter;

said at least one control parameter including at least one of a degree of command, a transmission, a speed command, and a direction command; and said at least one reference parameter including at least one of a skill, a road condition, a race pattern, a course layout, a driver's condition, a degree of fatigue, and positions of nearby running bodies.

15. A method of conducting a competitive race game in having a plurality of running bodies which are independently competitively physically moved along a race track from a starting position to a finishing position, a race being concluded when at least one of said plurality of running bodies reaches said finishing position, said method comprising the steps of:

setting a value corresponding to each of said plurality of running bodies for each of at least one parameter;

determining a target position for each of said plurality of running bodies, said target position representing a projected position for a respective one of said plurality of running bodies after passage of a predetermined interval based upon said at least one parameter;

physically moving each of said plurality of running bodies toward said target position;

repeating said steps of determining and moving for a particular one of said plurality of running bodies each time said target position is reached by said particular one; and preforming said step of repeating until at least one of said ruining bodies reaches said finishing position.

16. A method conducting a competitive race game in having a plurality of running bodies which are independently moved along a race track from a starting position to a finishing position, a race being concluded when at least one of said plurality of running bodies reaches said finishing position, said method comprising the steps of:

setting a value corresponding to each of said plurality of running bodies for each of at least one parameter;

determining a target position for each of said plurality of running bodies, said target position representing a projected position for a respective one of said plurality of running bodies after passage of a predetermined interval based upon said at least one parameter;

moving each of said plurality of running bodies toward said target position;

repeating said steps of determining and moving for a particular one of said plurality of running bodies each time said target position is reached by said particular one;

preforming said step of repeating until at least one of said running bodies reaches said finishing position;

detecting a present position of each of said running bodies at intervals shorter than said predetermined interval;

calculating a difference between said target position and said present position for each respective one of said plurality of running bodies; and said step of moving utilizes said difference to move each said respective one of said plurality of running bodies in a direction reducing said difference.

* * * * *